United States Patent [19]

Bevan et al.

[11] 4,417,774

[45] Nov. 29, 1983

[54] COLLAPSIBLE DISPLAY BOOTH

[75] Inventors: Mark H. Bevan, Manhattan Beach; Garry C. Kief, Los Angeles, both of Calif.

[73] Assignee: Hastings, Clayton, Tucker & Craig, Inc., Newport Beach, Calif.

[21] Appl. No.: 277,252

[22] Filed: Jun. 25, 1981

[51] Int. Cl.[3] ..... A47B 43/00; A47B 53/00; A47B 87/00

[52] U.S. Cl. ..... 312/108; 312/118; 312/199; 312/258

[58] Field of Search ..... 312/122, 114, 117, 198, 312/195, 199, 257, 258, 259, 292, 306, 312, 108

[56] References Cited

U.S. PATENT DOCUMENTS

| | | | |
|---|---|---|---|
| 431,587 | 7/1890 | Jandrey | 312/283 X |
| 2,576,750 | 11/1951 | Clark | 312/283 X |
| 3,650,591 | 3/1972 | Longmire, Sr. | 312/312 |
| 3,860,305 | 1/1975 | Bergman | 312/114 |
| 4,289,362 | 9/1981 | Kramer | 312/297 X |

*Primary Examiner*—William E. Lyddane
*Assistant Examiner*—Joseph Falk
*Attorney, Agent, or Firm*—Knobbe, Martens, Olson & Bear

[57] ABSTRACT

A collapsible display booth is disclosed which is used to vend merchandise at concerts on a tour, the booth comprising two easily movable boxes with storage areas inside the boxes for storing merchandise when the booth is being moved from one location to another, the merchandise being sold directly from the storage areas. The front box contains a sales counter, an elevated display which is mounted above the counter to prominently display the merchandise being vended, and two side doors which fold out of the front box to both form the sides of the booth and open the merchandise storage compartment in the front box. The rear box is fastened to the side gates of the front box to form a structurally secure, pilfer-resistant sales booth, and has an additional merchandise display which, when moved into position to display the merchandise, opens the merchandise storage area in the rear box to the interior of the booth.

8 Claims, 7 Drawing Figures

COLLAPSIBLE DISPLAY BOOTH

BACKGROUND OF THE INVENTION

In recent years, many popular musical performers have taken to the road, performing a series of concerts in many locations across the country. Many of these performers tour the concert circuit in a series of one night stands; that is, they perform one or two shows a day in a given location, and move to a different city for the next day's performance.

Since some of these performers may have concerts in as many as 200 cities in a single year, the schedules which they and the people who travel with them must follow are extremely tight. After a performance in the evening, everything must be packed and moved in trucks to the location of the next day's concert. Upon arriving in town, all of the equipment must be set up quickly, so that it is ready for the performance that evening.

An integral part of such concert tours is the sale of merchandise (such as posters, T-shirts, record albums, and various other souvenirs) which feature the star performer or performers of the tour. Since most of the people attending the concert are fans of the star performer, they are prime targets for the sale of such merchandise. As a result, the amount of such merchandise which can be sold at a personal appearance by the featured performer is quite large.

The amount of merchandise which may be sold is limited by the manner in which the merchandise is vended. Some concert facilities have no permanent souvenir booths. Some concert facilities have only one or two permanent souvenir booths from which such merchandise may be sold. When there are 5,000 or more potential customers, one or two selling booths simply do not provide nearly enough selling space. Because there is not enough selling space, customers are forced to wait in very long lines if they wish to purchase souvenirs. This invariably causes all but the most enthusiast fans to forego purchasing the souvenir, resulting in greatly diminished sales of merchandise.

Because there are such a great number of customers for a single booth, there is also a problem of running out of merchandise quickly. These booths do not have sufficient storage space, so the merchandise must be brought over in boxes and sold directly out of these boxes. This also wastes the time of the sales people, since they have have to sort through several boxes to find the desired article. If the booths should run out of the supply of one of the items being sold, that item must be brought in from a supply truck, a procedure which takes considerable time. During this time many potential customers may become tired of waiting and leave.

In addition, these booths do not have any display capability. Customers may not become aware what is offered for sale, except by moving up to the counter and inquiring. Many of the fans may not be aware that merchandise they may wish to purchase is available. Since many of these purchases are impulse purchases, they may never be made unless the merchandise is attractively displayed. Also, since many of these concerts are held in the evening, poor lighting is a frequent problem for, without proper lighting, the sales booth may be rather inconspicuous, causing many people to leave the concert location without having their attention drawn to the sales booth.

The majority of locations at which these concerts are held do not even have such sales booths from which merchandise may be sold. Some promoters have utilized booths set up on the spot at a concert location. These booths have had to date the disadvantages of the permanent booths as described above, and, in addition, they are very difficult to set up. It takes considerable time to unload, set up, knock down, and reload such booths, and since most road shows are on very tight schedules, such knock down booths are not very widely used.

In order to overcome some of these disadvantages, many concert sales people use folding card tables. Such card tables can be easily set up, and have the further advantage of being capable of being set up in multiple locations. These card tables have, however, many of the same disadvantages as the booths described above, for example, there is not enough selling space, and there is no display capability. With card tables, merchandise is sold out even more quickly than in booths.

In addition, there is a recurrent problem of merchandise being stolen as card tables have the disadvantage that they are quite unsecured. Large numbers of people mill around the entire sales area such that sales people can be quickly overwhelmed by the surrounding customers.

It can therefore be seen that the above described merchandise vending booths and tables are unsatisfactory for a variety of reasons, causing a great reduction in the amount of merchandise which could be sold.

SUMMARY OF THE INVENTION

The present invention provides a display booth which solves all of the above mentioned problems, and has several other advantages not found in the prior art. The display booth, when knocked down for travelling or storage, comprises two boxes which are rollable by two people. These boxes may be unloaded from the moving truck and easily rolled to the desired sales location.

When the boxes have been rolled to the sales locations, the sales booth can be very quickly completely set up, typically in under five minutes. When set up, the sales booth features a large counter where the sales may be made. The booth has a fairly high back to prevent people from approaching from behind the booth, and side doors connecting the counter with the back of the booth serve to keep unauthorized people from entering the booth.

The booth features two display areas—one located directly above the sales counter, and the other located in the back of the booth. Merchandise being sold can be displayed in these sales areas, thus informing potential customers what is available for sale. These display areas are provided with small lights to illuminate the booth.

Once the booth is set up, shelves within the display counter of the booth and in the back of the booth are open to the interior of the booth. These shelves are used to store merchandise in an orderly fashion, thus enabling sales people to quickly and efficiently find the merchanidise desired by the customer. Since the customers can be served more quickly, this enables a greater number of people to be served by a fixed number of sales people. In addition, since the booth has a built in storage area, the problem of running out of merchandise quickly is greatly lessened.

Since the display booth of the present invention is completely portable, a number of these display booths can be taken to a concert location and set up at multiple locations. With these multiple locations, lines will be shorter, and the amount of merchandise sold will be greatly increased.

After the crowds have left the concert, the display booth can be taken down just as easily as it was set up. The merchandise which is unsold remains inside the display booth, and is stored there. Since the merchandise is stored in the booths from which it is sold, the booths may be stocked to help in taking inventory of merchandise at any given concert location.

Another important advantage of the present invention is that since the boxes comprising the booth are made of an extremely strong impact-resistant material, when performances on multiple evenings at a single location are to take place, the boxes may be located securely at night by a padlock, and chained to a nearby fixture at the location. This eliminates the need for emptying the merchandise and storing it inside a truck.

Therefore, it can be seen that the display booth of the present invention is completely portable, and provides a secure sales location, stocking inventory in a way it may be located quickly for sale. Since multiple locations are used, each displaying the merchandise available for sale, sales may be greatly increased.

DESCRIPTION OF THE DRAWINGS

These and other advantages of the present invention are best understood with reference to the drawings, in which.

DESCRIPTION OF THE PREFERRED EMBODIMENT

Figure 1:
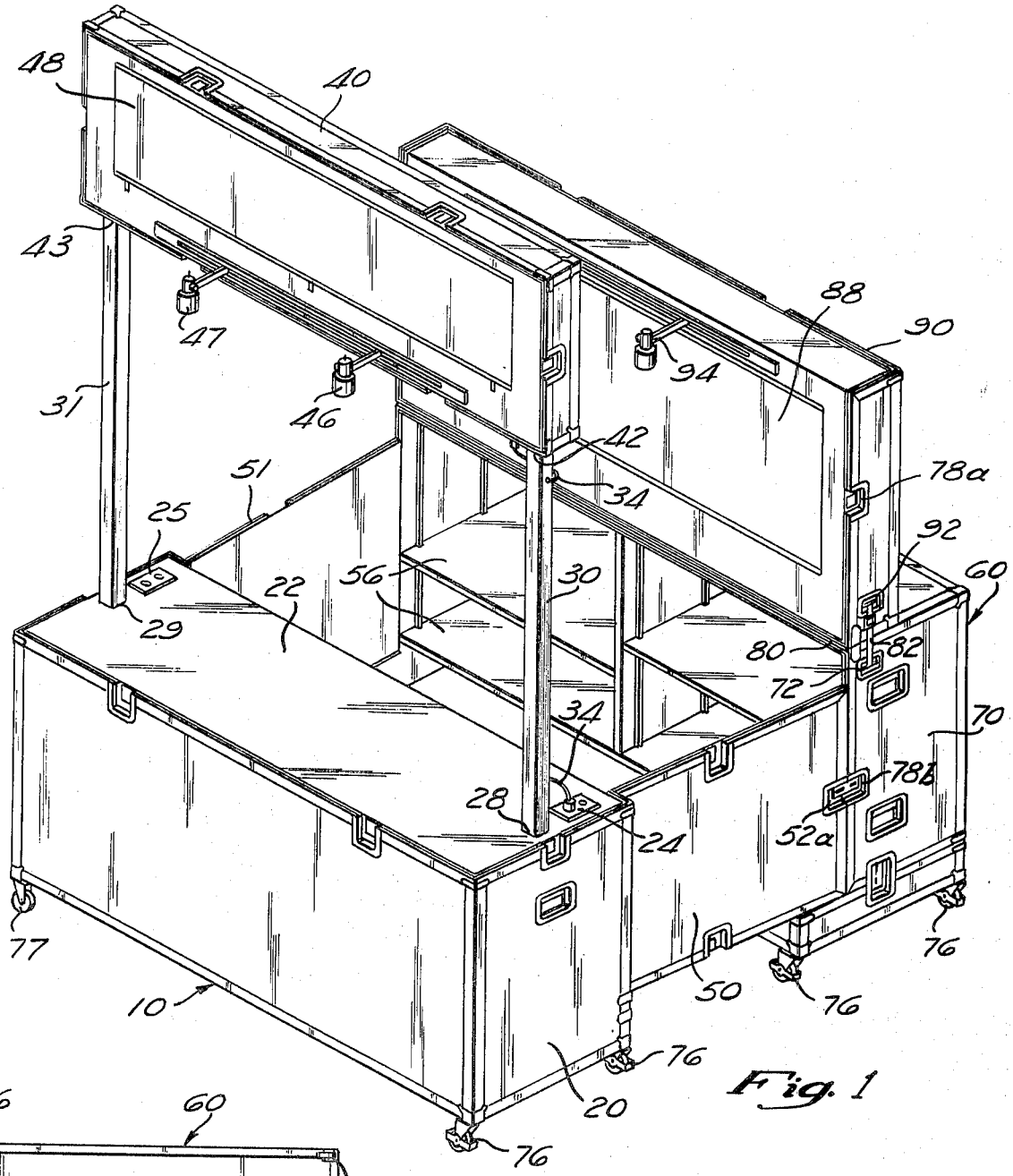
FIG. 1 is a perspective view of the collapsible display booth of the present invention, shown from the front, right and above.
Figure 3:
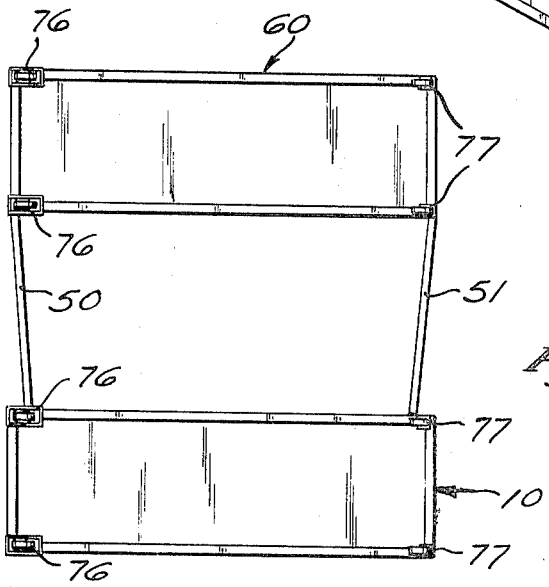
FIG. 3 is a bottom plan view of the collapsible display booth of the present invention.
Figure 2:
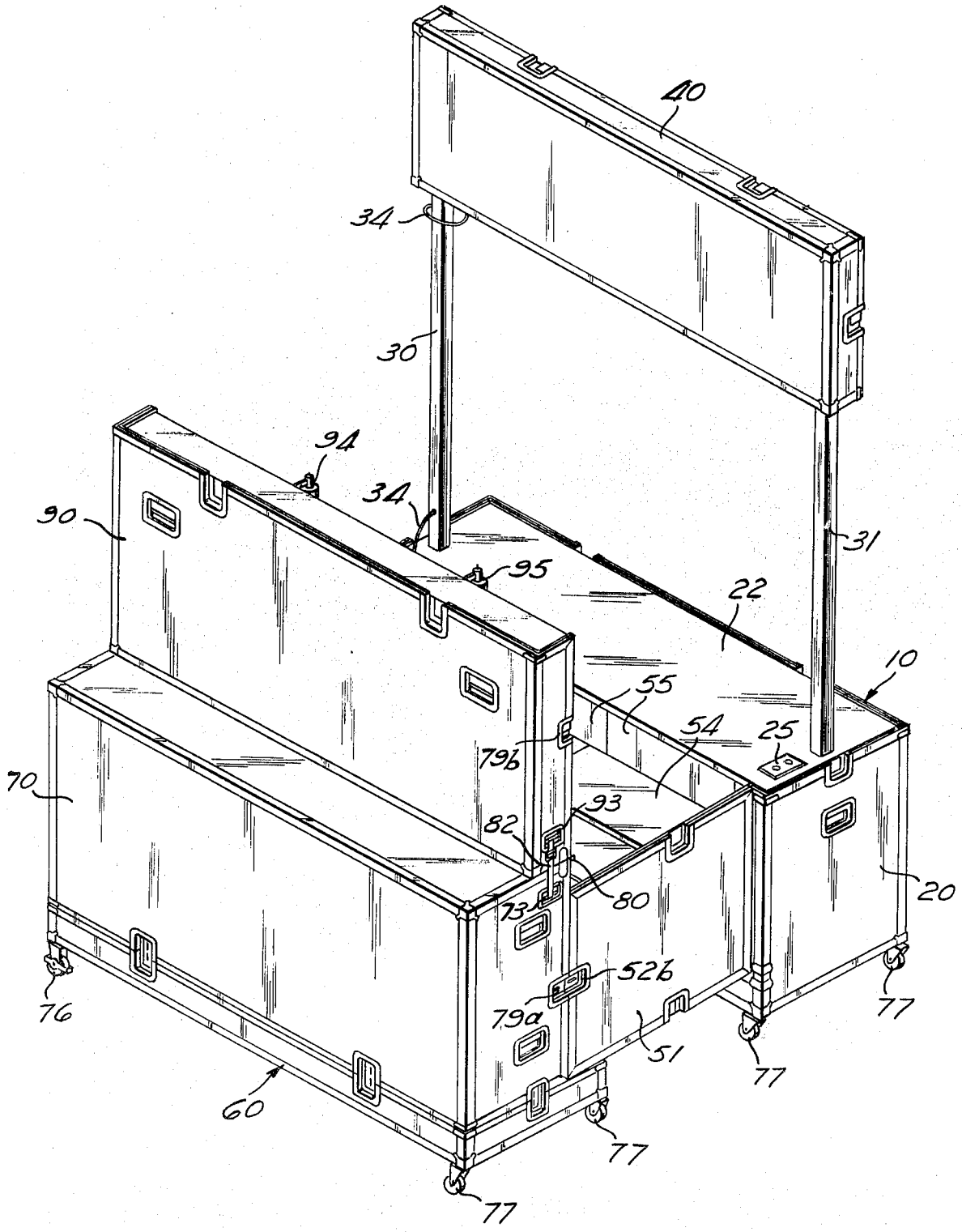
FIG. 2 is a perspective view of the collapsible display booth of the present invention, shown from the rear, left and above.
Figure 5:
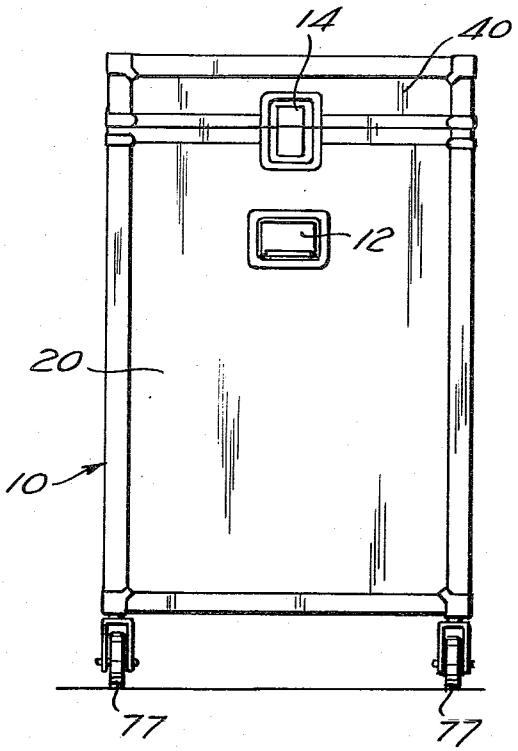
FIG. 5 shows a side view of the front box shown in FIG. 4, in a configuration for travelling.

In describing the collapsible display booth of the present invention, the following description will explain how the completed booth, shown in FIGS. 1–3, is assembled from the two collapsed boxes, shown in FIGS. 4–7.

Figure 4:
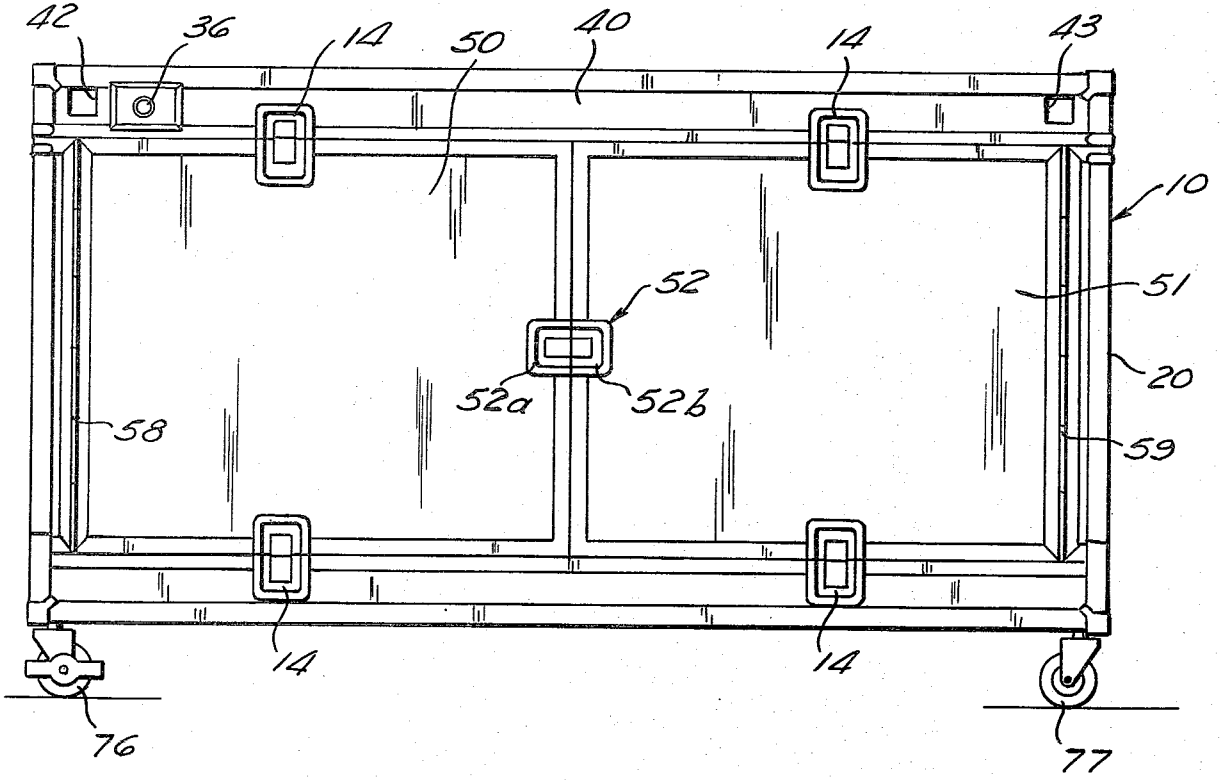
FIG. 4 shows the back side of the front box of the sales booth of the present invention, in a travelling configuration.
Figure 6:
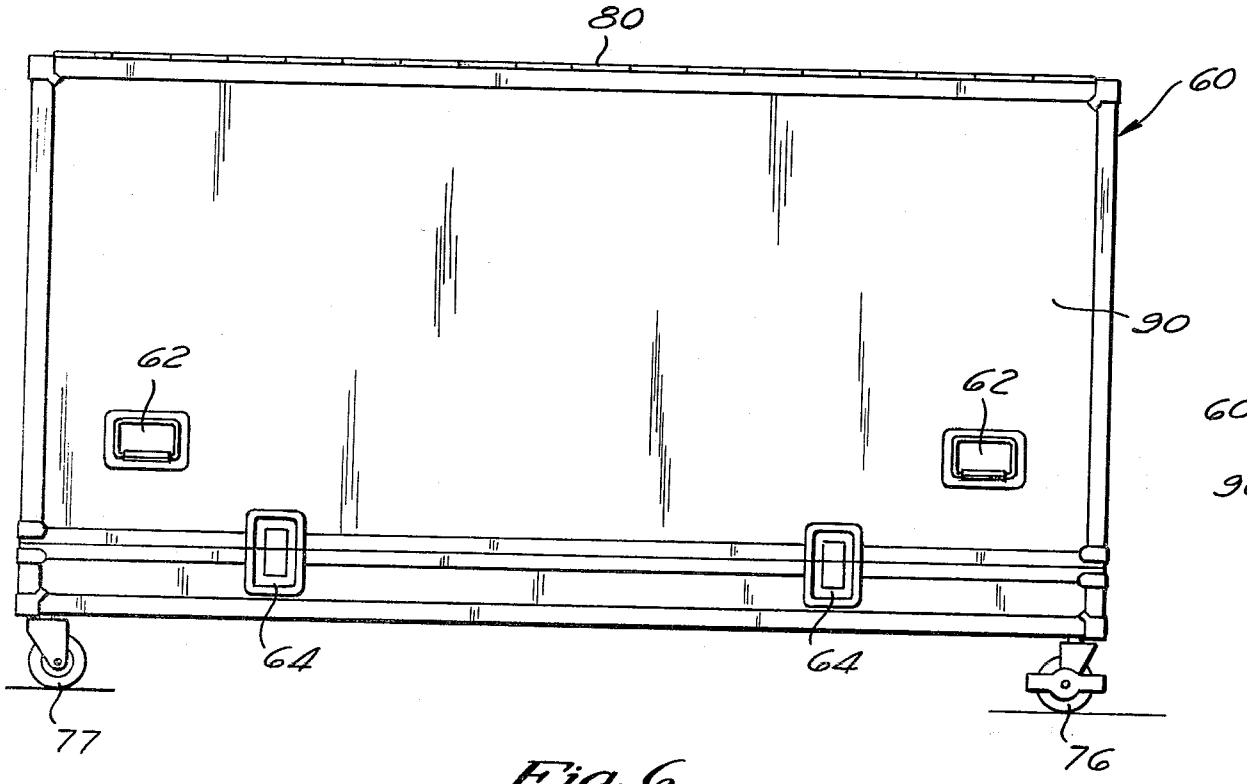
FIG. 6 shows a front view of the back box of the display booth of the present invention, in a travelling configuration.

When the moving truck arrives at the concert location, the front box 10 shown in FIG. 4 and the rear box 60 shown in FIG. 6 are unloaded from the truck. The unloading and moving of the boxes 10, 60 is easily accomplished since the boxes 10, 60 are equipped with wheels 76, 77. Each box may be moved by two people using the handles 12 (FIG. 5) on the front box 10, and 62 (FIG. 7) on the rear box 60. In this way, the two boxes 10, 60 are moved to the desired location for the display booth.

The front box may be assembled for use as follows. The front display 40 serves as the top of the front box 10 when the box is in its travelling configuration, as shown in FIG. 4. Several latches 14 spaced around the perimeter of the box secures the front display 40 to the front box 10. When these latches 14 are unfastened, the front display 40 may be removed from the top of the front box 10.

The doors 50, 51 are fastened to the front box 10 by hinges 58, 59 respectively. After the latches 14 have been opened, an additional latch 52, comprised of halves **52*a*, 52*b* is unfastened, and the doors 50, 51 may be opened. The two posts 30, 31, stored for travelling, may now be removed from the front box 10**.

These two posts 30, 31 are mounted into post holes 28, 29 located in the counter 22 on top of the front box 10. It may be noted that one of the posts 30 has a cord 34 attached to it. This cord is plugged into one of the two outlets 24, 25 mounted on top of the counter 22.

The front display also has two post holes 42, 43 (FIG. 4). By fitting the top of the posts 30, 31 into these post holes 42, 43, the front display is mounted above the counter 22. The other end of the cord 34 is then plugged into jack 36 (FIG. 4) in the front display 40.

Figure 7:
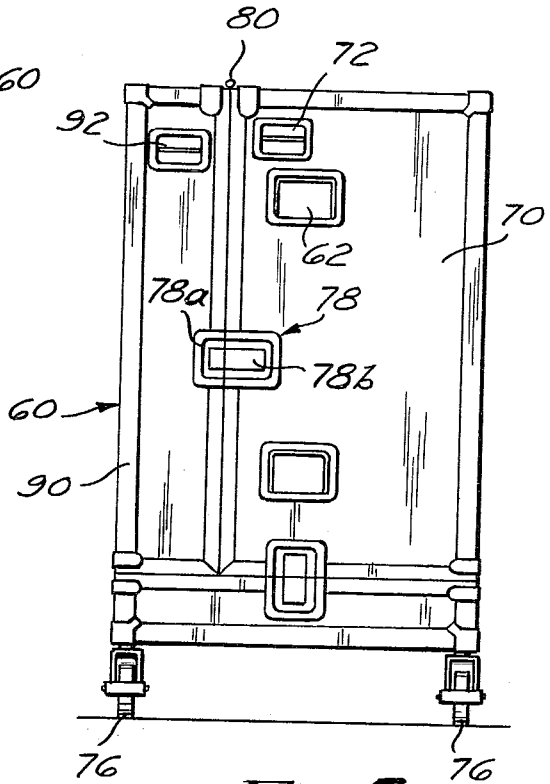
FIG. 7 shows a side view of the back box shown in FIG. 6, in a travelling configuration.

The rear box 60 shown collapsed for travel in FIGS. 6 and 7, is assembled by unfastening latches **64, 78*a* and *b*, and 79*a* and *b*. When these latches are unfastened, the rear display 90, which is fastened to the rear storage box 70 by a hinge 80 (FIG. 7), may be moved to its upright position as shown in FIG. 1. Two handles 62 are provided on the rear display 90 for this purpose. Once the rear display 90 has been moved to its upright position, two elastic straps 82, 83 are fastened to elastics strap retainer pairs 72, 92 and 73, 93 to secure the rear display 90 to the rear storage box 70**.

Once the front box 10 and the rear box 60 have been assembled, all that remains is to attach them together. This is done by fastening hinge half **52*a* to hinge half 78*b*, and 52*b* to 79*a*. The entire booth is now assembled into one unit (FIG. 3), and may be positioned easily before the locking wheels 76 are locked to hold the booth in the desired location. Lamps 46, 47, 94, and 95**, fold out and may be energized by supplying electrical power to the booth.

The present invention has several significant features. Referring to FIGS. 1 and 2, it may be seen that the front box 20 has shelves 54 and drawers 55 inside it (FIG. 2) and the rear storage box 70 has shelves 56 inside it (FIG. 1). These shelves are used to store material while the boxes are travelling, and are used to keep different items of merchandise separate, so that they may be easily located for sale.

The sales personnel operate behind the counter 22, and may enter and leave the booth from doors 50, 51. It can be seen that the back and sides of the booth are secure, allowing customers to approach the booth only from the front of the booth. This, of course, will reduce the amount of pilferage experienced.

This booth features two display areas, front display 40 and rear display 90. The front display 40 has a clear display cover 48 which is used to hold and display some of the items being sold, such as posters and T-shirts. The rear display 90 also has a clear display cover 88, and can display additional merchandise for sale. By having these displays, the booth of the present invention provides information to potential customers on what merchandise is available for sale.

Where concerts are being held on multiple nights in a single location, the present invention enables an extensive stock of merchandise to be stored within the boxes 10, 60 both on location and while travelling. The latches on these boxes 14, 64, may be fastened and locked with a padlock, and the boxes can then be chained to some fixed point, and will be secure without necessitating storage of the boxes in a truck. The boxes are preferably made of some extremely strong material which is impact resistant, such as the coated wood material widely used in the entertainment industry to house the electrical loud speakers used by travelling concerts.

The fact that the boxes 10, 60 are used to store the merchandise being sold allows two advantages not found in the other sales booths or tables. First, inventory can be stored in the boxes while the show is travelling from one town to another. Upon arriving at the concert location, by simply moving the boxes from the truck to the sales location, a complete stock of the merchandise to be sold is also moved to the sales location, thus enabling rapid setup after arriving at the location of the concert.

The second advantage of storing merchandise in the boxes 10, 60 is that a complete inventory of the merchandise on hand may be taken by simply counting how many fully stocked boxes remain. Since each one of the two boxes used in the display booth of the present invention is fairly large, complete stock of the inventory on hand can be determined very quickly.

Thus, it can be seen that the collapsible display booth of the present invention is a substantial improvement over the old booths or card tables previously used. The booth is very simple to set up in any location desired. Since this booth is completely portable, multiple locations not possible with fixed sales booths now become quite simple to implement. Also, the booths have two display areas in which the merchandise being sold may be prominently displayed above the level of the crowd.

Since the booth holds a complete stock of merchandise being sold in several compartments, the sales people can quickly locate the desired item, thereby enabling a fixed sales staff to sell more merchandise in a given time. Since the booth holds a considerable amount of merchandise in its storage compartments, the common problem of running out of merchandise is virtually eliminated. Since the booth has doors on the side and a complete barrier in the back, the sales area is completely secured, thus preventing merchandise from being stolen.

Since the booth may be set up and knocked down very quickly, tight schedules necessitated by a series of one night stands are no longer a problem. The final, and perhaps most important, advantage of the present invention is that at any given concert location considerably more merchandise may be sold by utilizing the display booth of the present invention than could be sold by using older techniques. More customers can be serviced by the same size sales staff, and a greater profit at each concert can be realized.

We claim:

1. A collapsible portable display booth for selling merchandise, comprising:

counter means at the front of said booth, said counter means being not less than two feet high nor more than four feet high, said counter means being used as a sales point;

a back portion of said booth, said back portion being not less than two feet high;

a pair of doors for connecting said counter means with said back portion, said doors separating said counter means and said back means by at least two and one-half feet, said doors being fastened to said counter means by hinging means and collapsing into said counter means for transportation from one location to another; and merchandise display means, said display means being elevated above said counter means, said display means being collapsible so as to fit on said counter means for transportation from one location to another.

2. A collapsible portable display booth as defined in claim 1, further comprising:

storage means contained under said counter means, said storage means allowing a supply of said merchandise to be stored for convenient transportation of said merchandise from one location to another, said doors sealing said merchandise within said storage means when said doors are collapsed into said counter means.

3. A collapsible portable display booth as defined in claim 2, further comprising:

second storage means contained within said back portion of said booth, said second storage means allowing an additional supply of said merchandise to be stored for convenient transportation of said additional merchandise from one location to another; and means for securely sealing said second storage means, said sealing means collapsing onto said back portion of said booth so that said back portion of said booth may be transported from one location to another with said additional merchandise securely stored within said back portion of said booth.

4. A collapsible portable display booth as defined in claim 3, wherein said means for securely sealing said second storage means also functions as a second merchandise display means.

5. A collapsible portable display booth as defined in claim 1, further comprising:

plural wheels for transporting said counter means and said back portion of said booth at least some of said wheels being lockable to secure said booth to a fixed location.

6. A collapsible portable display booth for selling merchandise, comprising:

a front portion, behind which is located a sales area from which merchandise is vended, said front portion being collapsible into a single unit so that it can be easily moved from location to location;

a back portion, said back portion being sufficiently sturdy to prevent customers from approaching said sales area from said back portion, said back portion being collapsible into a single unit so that it can be easily moved from location to location;

means for securing the area between said front portion and said back portion, said securing means being sufficiently sturdy to prevent customers from reaching said sales area behind said front portion, said securing means also preventing pilferage from said sales area, said securing means being collapsible into at least one of said front portion and said back portion for moving said booth from one location to another; and at least one elevated display, said elevated display located above said booth and displaying said merchandise offered for sale, said elevated display being collapsible into at least one of said front portion and said back portion for moving said booth from one location to another.

7. A collapsible portable display booth as defined in claim 6, further comprising:

means for storing said vended merchandise, said storage means contained in said front portion and said rear portion, said storage means allowing a supply of said merchandise to be stored during times when said booth is being moved from one location to another.

8. A collapsible portable display booth as defined in claim 7, further comprising:

second merchandise display means, said second display means being collapsible to securely seal one of said storage means contained in said front portion and said rear portion.

* * * * *